United States Patent [19]

Heddon

[11] 4,421,309

[45] * Dec. 20, 1983

[54] MODULAR BOWLING LANE SYSTEM

[76] Inventor: Will Heddon, P.O. Box 3416, Lake Wales, Fla. 33853

[ * ] Notice: The portion of the term of this patent subsequent to May 26, 1998 has been disclaimed.

[21] Appl. No.: 205,611

[22] Filed: Nov. 10, 1980

Related U.S. Application Data

[63] Continuation-in-part of Ser. No. 47,357, Jun. 11, 1979.

[51] Int. Cl.[3] ..... A63D 1/04

[52] U.S. Cl. ..... 273/51; 52/126.7

[58] Field of Search ..... 273/51; 52/126, 285

[56] References Cited

U.S. PATENT DOCUMENTS

| | | | |
|---|---|---|---|
| 540,038 | 5/1895 | Wiggins | 273/51 |
| 543,141 | 7/1895 | Rieper | 273/51 |
| 1,795,624 | 3/1931 | Treiber | 273/51 |
| 2,209,082 | 7/1940 | Debay | 273/51 |
| 2,956,652 | 10/1960 | Liskey | 52/126 |
| 3,014,722 | 12/1961 | Green | 273/51 |
| 3,476,387 | 11/1969 | Cepluch | 273/51 |
| 3,479,070 | 11/1969 | Marateck et al. | 52/285 |
| 4,139,671 | 2/1979 | Kelly et al. | 273/51 X |
| 4,269,411 | 5/1981 | Heddon | 273/51 |

FOREIGN PATENT DOCUMENTS

| | | | |
|---|---|---|---|
| 733866 | 5/1966 | Canada | 273/51 |

*Primary Examiner*—Anton O. Oechsle

*Attorney, Agent, or Firm*—Duckworth, Allen, Dyer & Pettis

[57] ABSTRACT

The modules of a modular bowling lane system are fabricated at a manufacturing facility. Each lane module and approach module includes a rectangular deck formed from a plurality of hardwood strips adhesively bonded side to side in a single layer. The upper end of each of a plurality of jack screws is coupled to the lower surface of each lane module while the lower end of each jack screw is coupled to the bowling alley leveling strips. The jack screws permit the lane modules to be leveled and vertically adjusted. Various structural components are provided to couple the modules to adjacent modules and to abutting sections of existing lane structure to thereby anchor the modules and prevent vertical displacements of the modules. Approach fill modules are provided to fill in the gaps between the approach areas of adjacent lanes. Each approach fill module is supported by a plurality of approach fill supports which are coupled to the approach modules of adjacent lanes.

18 Claims, 23 Drawing Figures

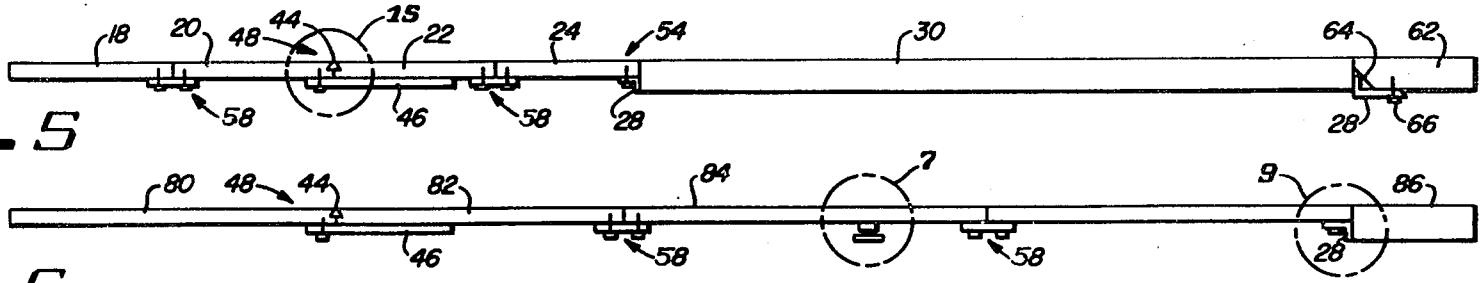
FIG. 5
FIG. 6
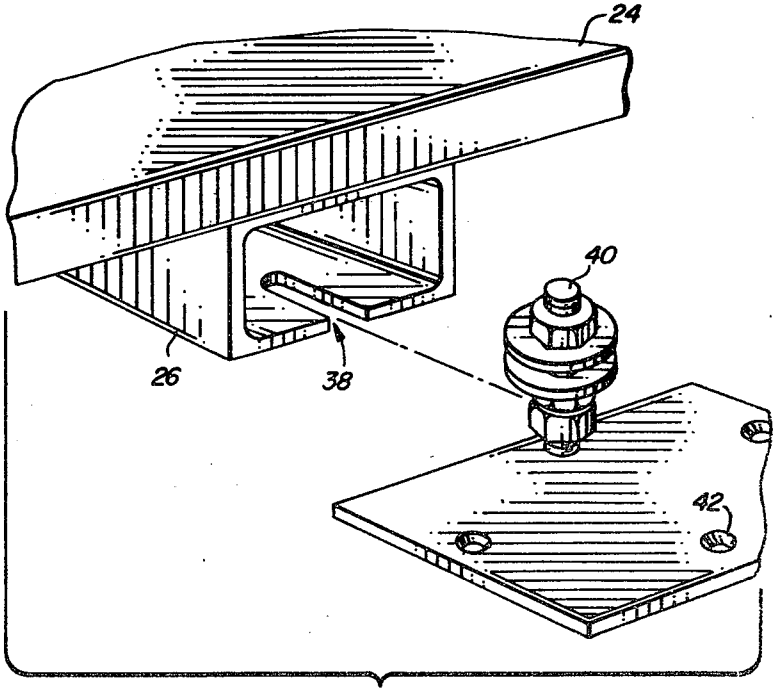
FIG. 8
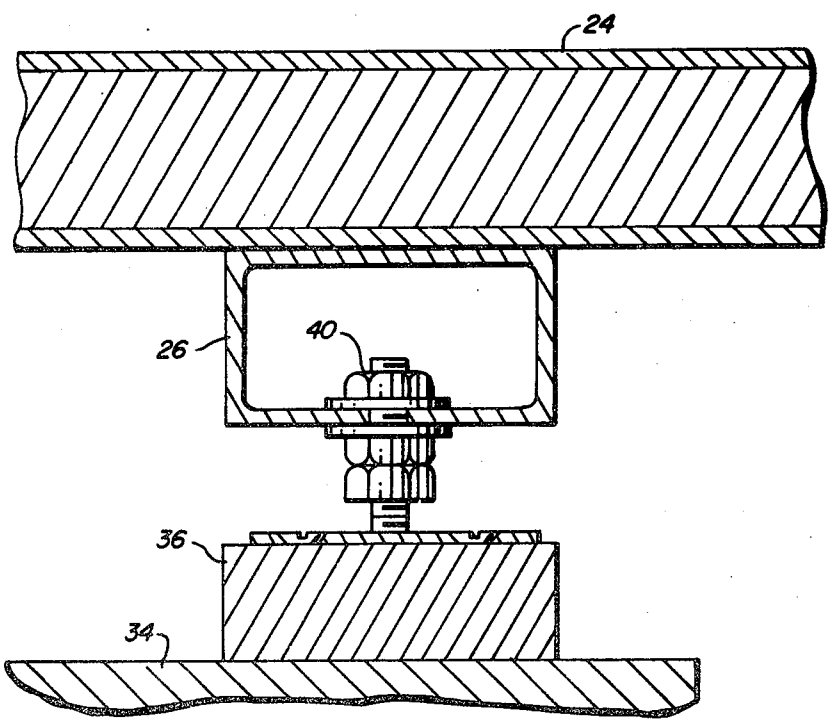
FIG. 7

FIG. 10
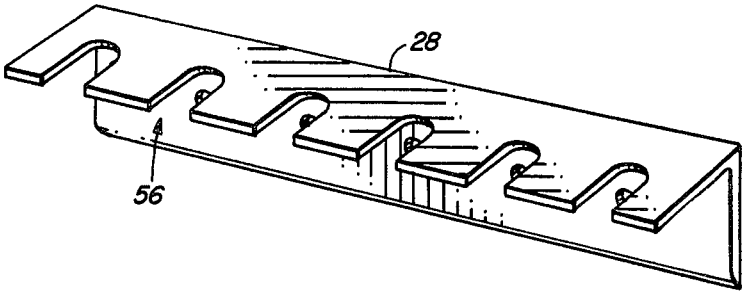
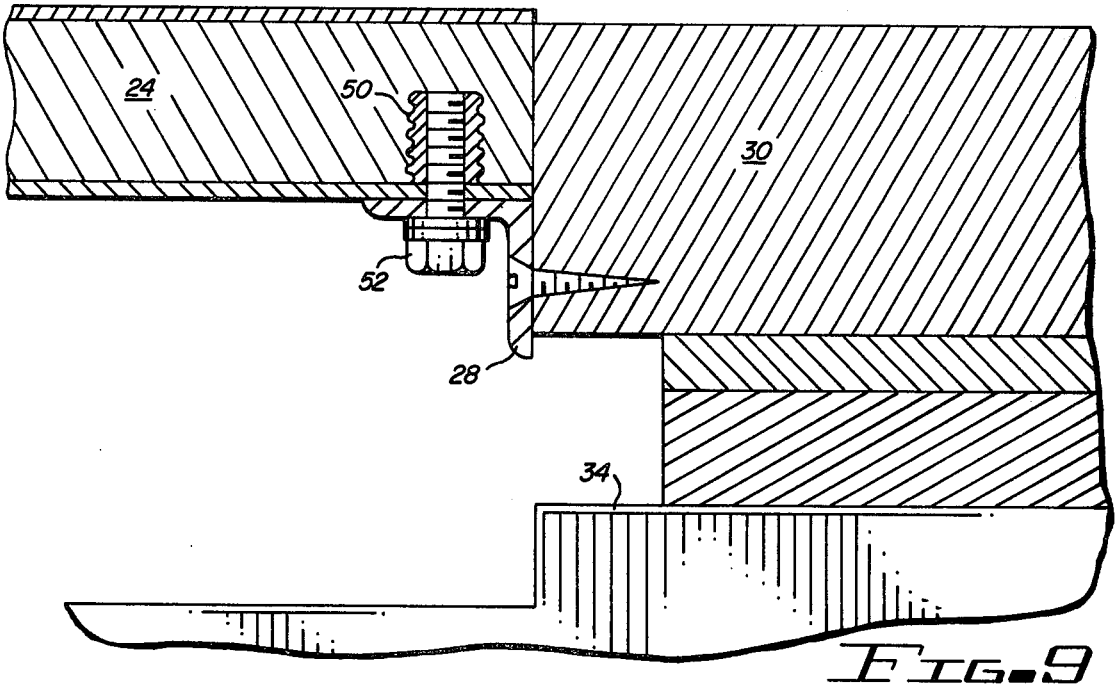
FIG. 9
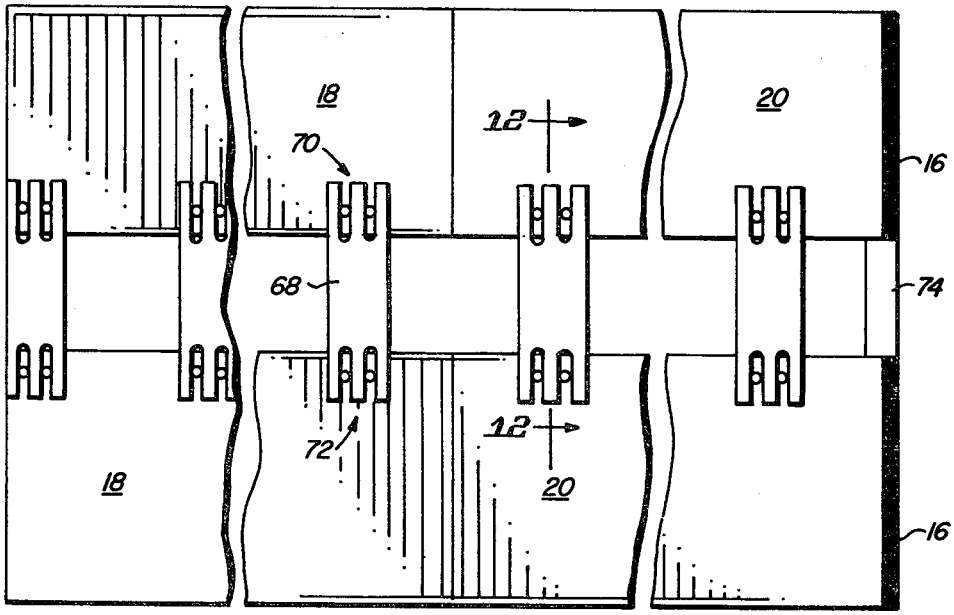
FIG. 11

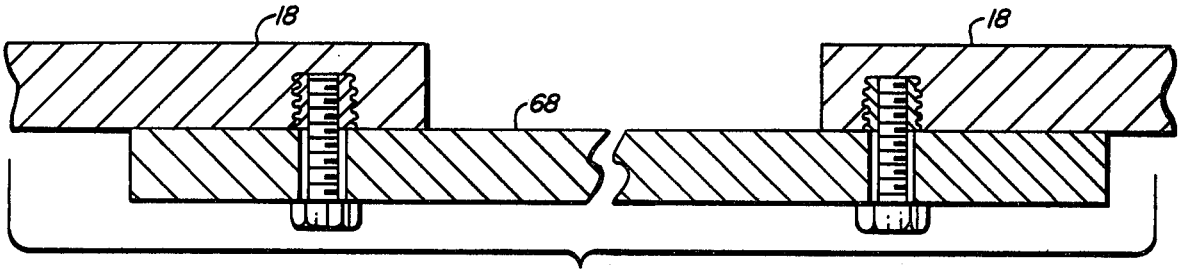
FIG. 12
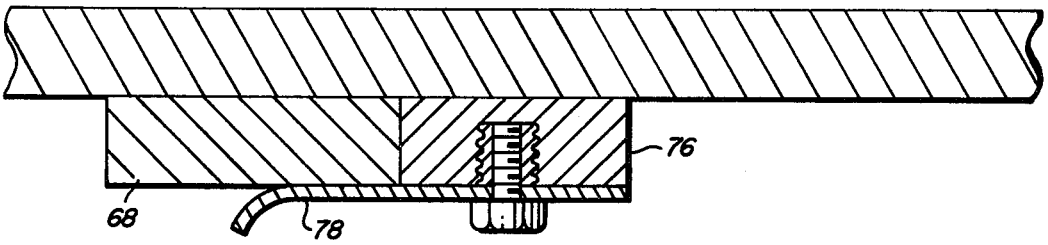
FIG. 13
FIG. 14
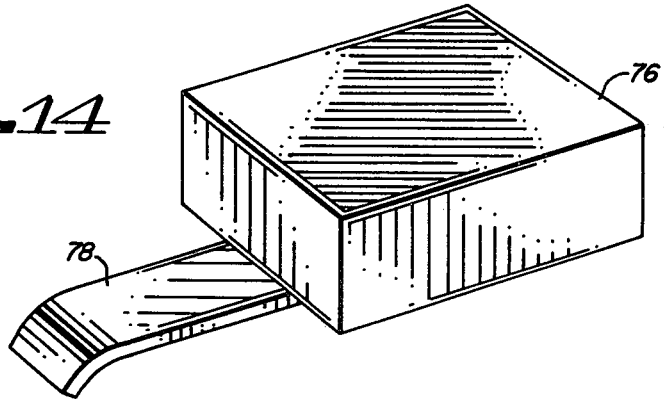
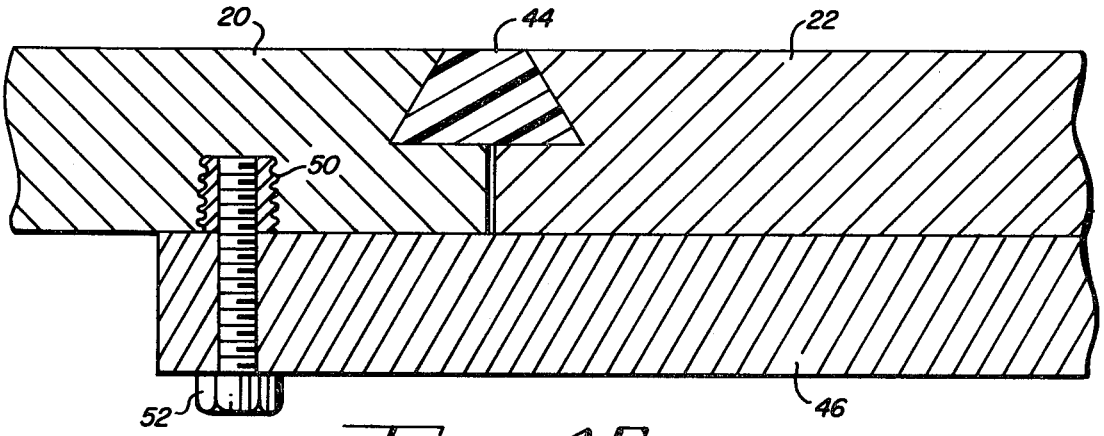
FIG. 15

FIG. 16
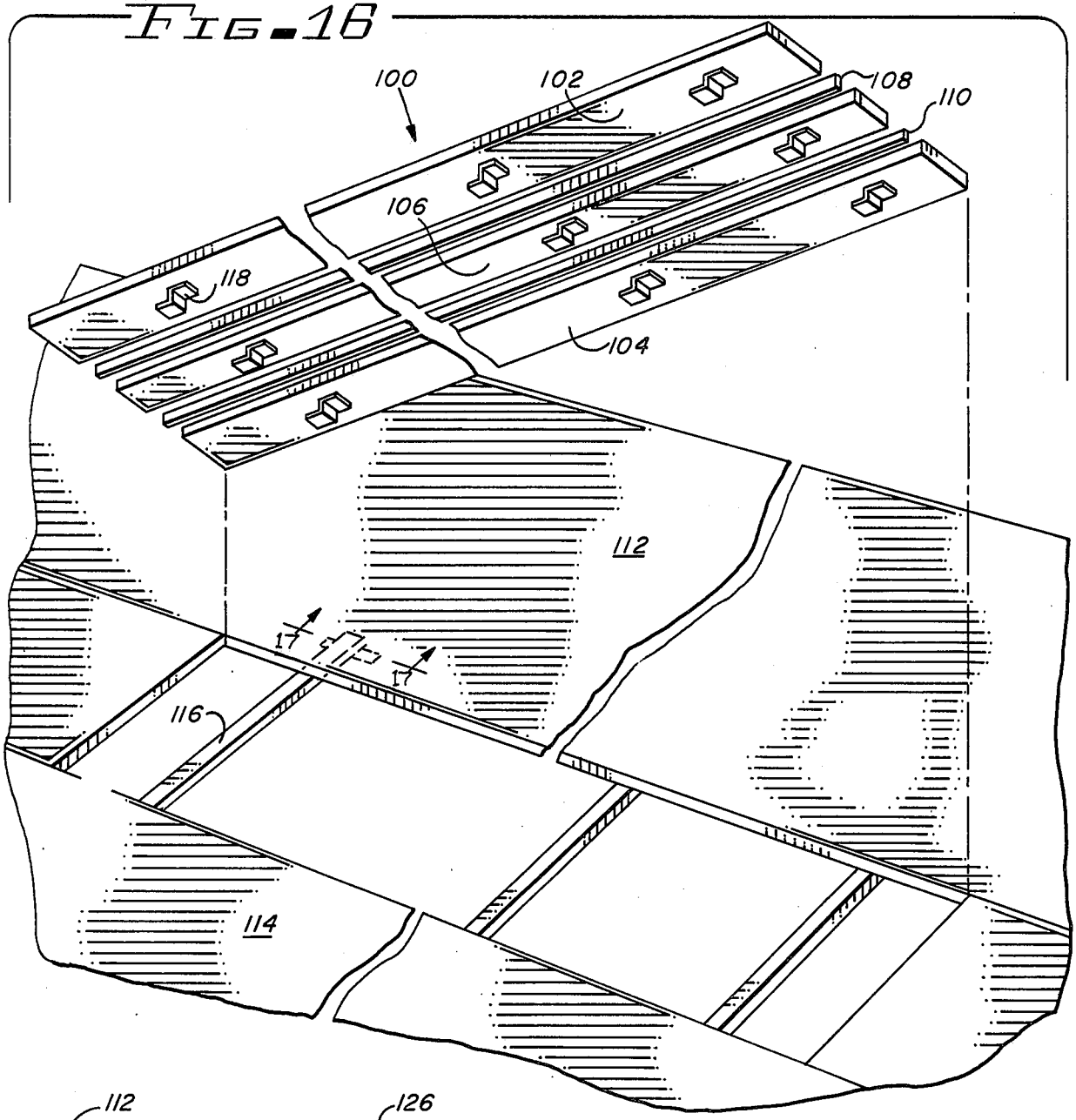
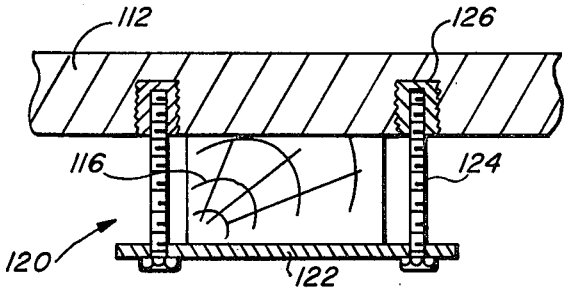
FIG. 17
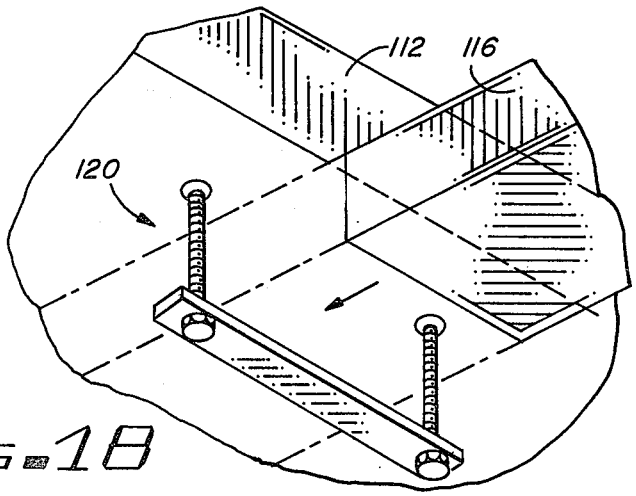
FIG. 18

MODULAR BOWLING LANE SYSTEM

This application is a continuation-in-part of U.S. patent application Ser. No. 047,357, filed on June 11, 1979.

BACKGROUND OF THE INVENTION

1. Field of the Invention

This invention relates to bowling lane construction, and more particularly to the manufacturing and assembly of pre-fabricated wooden bowling lane modules.

2. Description of the Prior Art

After about 20 years of use and periodic refinishing of the surface of bowling lanes, a sufficient amount of the hardwood surface of each lane will have been removed so that a part or all of the lane must be replaced. Replacement of a complete bowling lane is a time consuming and costly procedure. The existing lane structure must be removed and a replacement lane must be assembled by hand at the installation site. This replacement operation involves reconstructing the laminated hardwood lane deck by nailing tongue and groove hardware strips together at 8-inch intervals. Thousands of nails are used in reconstructing a single lane of a bowling alley. Additionally, a large number of lag screws must be installed by hand at intervals along the outer edge of each hardwood deck to rigidly secure the lane deck to the underlying lane support structure.

Since the entire installation assembly must be completed at the job site, substantial expenditures are incurred in transporting a highly skilled 20 man installation crew to the construction site. Additional expenses are incurred in providing the lodging and meals required by the work crew. During the lane replacement operation, the bowling alley is closed and its income generating capacity terminates.

U.S. Pat. No. 3,476,387 (Cepluch) discloses a portable bowling alley structure which includes a plurality of box channel structures which are coupled to the lane section of the bowling alley by securing means inserted through the upper surface of the lane itself. A jack screw type leveling device includes a vertically adjustable nut which supports the box channel from below and permits vertical adjustment of various sections of the portable bowling lane structure. Abutting lane sections are secured together by horizontally oriented securing means that couple abutting lane sections to a vertically oriented sideboard.

U.S. Pat. No. 2,209,082 (Debay) discloses a specific configuration of a bowling alley bed. FIGS. 17 and 18 of the Debay patent illustrate that concrete posts in combination with vertically oriented metal channels are utilized to provide support for a plurality of jack screw leveling devices. Rectangular metal plates are placed above the underlying support structure and serve as the rolling surface of the lane. This embodiment is provided with means to absorb the metallic sounds produced by a ball rolling over the metallic lane surfaces.

U.S. Pat. No. 543,141 (Rieper) discloses a laminated wooden bowling alley structure which is fabricated in sections and which includes jack screw leveling devices. The abutting sections of the bowling alley are laminated together during the installation process. U.S. Pat. No. 1,795,624 (Trieber) discloses a laminated bowling alley structure which is held together by a plurality of nails and which includes structure for providing vertical adjustment of the lane sections.

U.S. Pat. No. 3,201,454 (Bailey) discloses a replaceable ball drop zone panel and includes structure for providing vertical adjustment of the panel to assure that the upper surface of the panel is properly aligned with the upper surface of the existing remaining lane structure.

U.S. Pat. No. 757,922 (Hervst) discloses a wooden bowling alley structure which includes threaded devices on each side to provide vertical adjustment and leveling of various sections of the bowling lane.

U.S. Pat. No. 3,223,415 (Stengel) discloses a bowling lane structure fabricated from granite which includes threaded leveling devices for properly leveling the granite slabs used for the bowling lane surface.

U.S. Pat. No. 1,529,295 (Blanchard) discloses a collapsible bowling alley which includes structurally complex support means positioned at the interface between two adjoining lane sections. These support devices also include a bolt and wing nut combination which secure the ends of abutting lane sections together by clamping two ninety degree brackets which are secured to the lower surfaces of the abutting lane sections. A pair of vertically oriented wooden support members are positioned between the two ninety degree brackets.

U.S. Pat. No. 3,014,722 (Green) discloses a prefabricated bowling lane floor structure for outdoor use. The various sections of this assembly are joined together by splice planks which fit in horizontal grooves cut into the abutting ends of adjacent lane sections. A turnbuckle coupled to a specially configured bracket secured to the lower surface of the abutting ends of adjacent lane sections holds the abutting lane sections together and maintains the splice plank in position. Bracket devices are also provided to vertically adjust the level of each bowling lane section following initial set up of the portable structure.

U.S. Pat. No. 2,788,973 (Grawey) discloses a bowling alley constructed from pre-fabricated laminated lane sections which are leveled by conventional techniques and which are secured by a plurality of lag bolts to the underlying lane support structure. The end of each pre-fabricated lane sections includes a horizontally disposed groove for receiving a splice plank which assists in securing abutting lane sections together.

Other prior art of interest is disclosed in the following U.S. Pat. Nos.: 2,493,620 (Cusano); 1,511,696 (Wendt); 2,969,983 (DeVore); 2,039,580 (Borders); 490,916 (Montgomery); 2,301,778 (Gremp); 2,686,054 (Coroniti); 3,312,469 (Clayton); 4,036,496 (Robinson); 3,670,049 (Stein); 631,090 (Mussey); 563,362 (Dokkenwadel); 471,244 (Montgomery); 1,961,765 (James); 1,724,841 (Karr); 359,542 (Wolff); 2,301,777 (Gremp); 1,581,423 (Blanchard); 2,483,976 (Hughes); 2,479,477 (Cusano) and 1,967,858 (Borders).

SUMMARY OF THE INVENTION

It is therefore a primary feature of the present invention to provide a modular laminated wooded bowling lane system which can either completely or partially replace an existing bowling lane and which can be prefabricated in modules at a manufacturing facility and rapidly installed in the field.

Another feature of the present invention is that the modular bowling lane sections of the present invention are fabricated without the presence of nails or screws in the laminated deck.

Yet another feature of the present invention is the provision of pre-fabricated wooden modules formed from a plurality of hardwood strips adhesively bonded side to side in a single layer.

Still another feature of the present invention is the provision of a modular bowling lane system the elements of which can be readily removed and replaced or repaired.

In a bowling alley having a lane, leveling strips positioned below and perpendicular to the lane, and lane support structure positioned below the leveling strips and parallel to the lane, a modular lane system comprises a rectangular deck having an end and upper and lower surfaces. The deck is formed from a plurality of hardwood strips adhesively bonded side to side in a single layer to form a lane module. Means is coupled to the module and to the leveling strips to support the module at a predetermined distance above the lane support structure. A coupler bar is positioned below one end of the module for coupling that end of the module to an adjacent section of the lane and for preventing relative vertical displacement between the module and the adjacent section of the lane. The coupler bar includes a vertical face having a plurality of passageways for receiving first securing means to attach the vertical face of the coupler bar to the end of the adjacent lane section. The coupler bar also includes a horizontal face having a plurality of passageways for receiving second securing means to attach the horizontal face of the coupler bar to the lower surface of the module.

The present invention also contemplates a modular approach fill system for filling in the gap between the approach areas of first and second adjacent bowling lanes. The modular approach fill system comprises an approach fill module formed from a plurality of hardwood strips adhesively bonded side to side in a single layer. Approach fill support means having one side coupled to the approach area of the first lane and a second side coupled to the approach area of the second lane supports the lower surface of the approach fill module and maintains the upper surface of the module level with the upper surface of the approach area of the first and second lanes.

DESCRIPTION OF THE DRAWINGS

The invention is pointed out with particularity in the appended claims. However, other objects and advantages, together with the operation of the invention may be better understood by reference to the following detailed description taken in connection with the following illustrations wherein:

FIG. 5 is a cross-sectional diagram of a bowling lane which has been partially replaced by the modular bowling lane system of the present invention.

FIG. 6 is a cross-sectional diagram of a bowling lane which has been completely replaced by the modular bowling lane system of the present invention.

FIG. 7 is an elevational view particularly illustrating the relative alignment and coupling between a lane module, a box channel support, a pine foot support and a stringer.

FIG. 8 is an exploded perspective view of a lane module and a box channel support, particularly illustrating the manner in which a jack screw foot fits into the notch of a box channel support.

FIG. 9 illustrates the manner in which a coupler bar joins a lane module to an existing lane section.

FIG. 10 is a perspective view of a coupler bar utilized in connection with the modular bowling lane system of the present invention.

FIG. 11 is a view from below of the approach modules of two adjacent bowling lanes, particularly illustrating the alignment and coupling of the approach fill means slats.

FIG. 12 is a view of a slat illustrated in FIG. 11, taken along section line 12—12.

FIG. 13 is a sectional view particularly illustrating the manner in which a clip secures an approach fill module to an approach fill support plank.

FIG. 14 is an enlarged perspective view of the clip illustrated in FIG. 13.

FIG. 15 is a cross-sectional view of the junction between a ball drop module and the foul line end of an approach module, particularly illustrating the foul line insert.

FIG. 16 represents a perspective view of an approach fill module of the present invention which is formed from first and second wing panels and a centrally positioned keyway panel.

FIG. 17 is a sectional view, taken along section line 17—17, of the clamping means illustrated in FIG. 16.

FIG. 18 is a perspective view from below particularly indicating the manner in which the end of a slat is inserted into the clamping means of the present invention.

DESCRIPTION OF THE PREFERRED EMBODIMENT

In order to better illustrate the advantages of the invention and its contributions to the art, a preferred hardware embodiment of the invention will now be described in some detail. Thereafter, the method of manufacturing the laminated hardwood modules utilized in connection with the present invention will be described in detail.

Several different types of modules utilized in connection with the preferred embodiment of the present invention permit selective or total replacement of an existing bowling lane. A typical present day bowling alley includes a plurality of bowling lanes. Lane support structure known as stringers are coupled to the concrete foundation of the building and are oriented parallel to the bowling lanes. Leveling strips are placed above and perpendicular to the stringers and serve as a level structural support for supporting bowling lanes which are fabricated on site by nailing together at eight inch intervals a plurality of small maple or pine strips in a side-by-side relationship. After approximately 20 years of use and many intervening resurfacing procedures, the thickness of the laminated deck panels will have been decreased to the extent that the nails which secure the wood strips together are about to be exposed and further refinishing is impossible. At this time it is necessary to either replace the entire bowling lane or to replace high wear areas such as the lane approach area where the player makes his approach to deliver the ball and the ball drop zone of the lane where the ball normally makes its initial contact with the lane structure. The pin deck area also constitutes an area of rapid wear and must be frequently replaced.

The present invention comprises a variety of related, but somewhat different, types of modular lane replacement sections which can be pre-fabricated at a factory having highly specialized and efficient production machinery. Utilization of this modular concept permits virtually all high cost laborers and management personnel to operate from a centralized location while permitting comparatively low cost labor to be utilized at the actual bowling lane replacement site to install the prefabricated modular replacement units.

Figure 1:
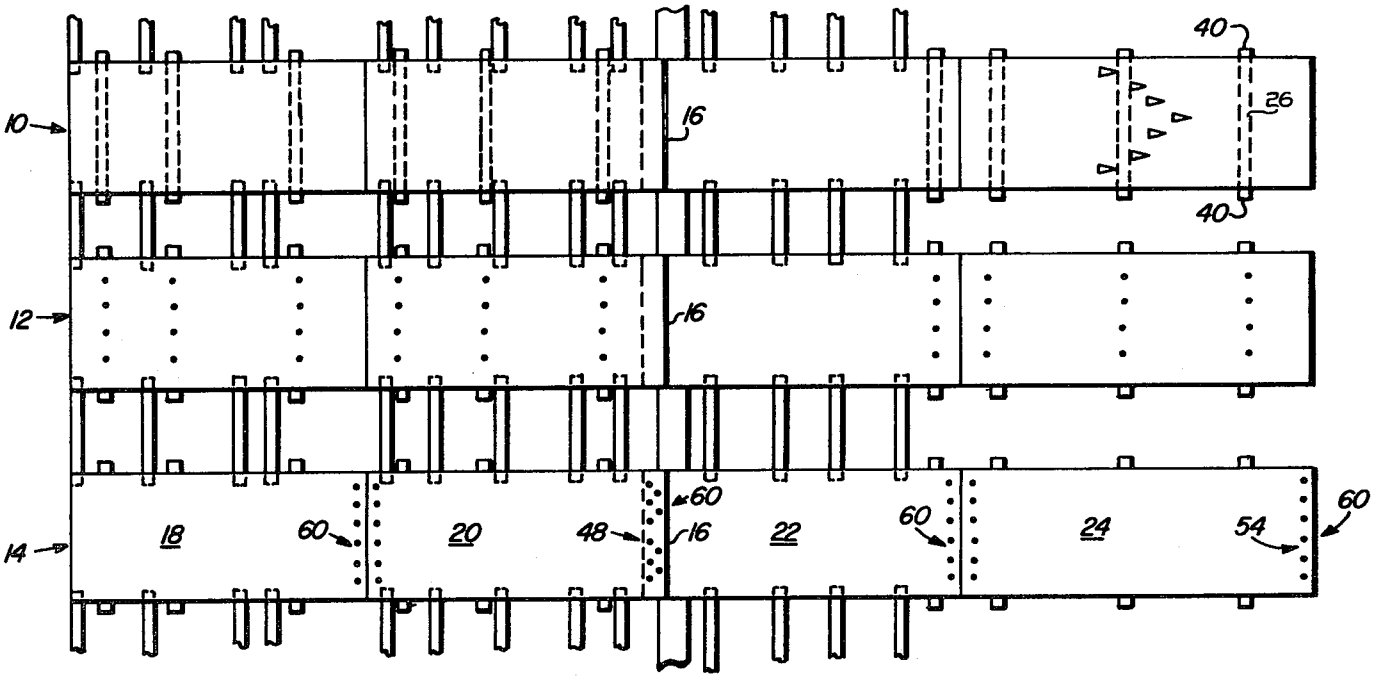
FIG. 1 is a view from above of the foul line end of three adjacent identical bowling lanes illustrating various structural features of the modular bowling lane system of the present invention.

Referring to FIG. 1, the location and general configuration of each of the different types of modular replacement sections will be described in general and will later be described in substantially more detail by reference to additional figures.

FIG. 1 represents a view from above of bowling lanes 10, 12 and 14. The foul line of each bowling lane is designated by reference number 16. In FIG. 1, bowling lanes 10, 12 and 14 are structurally identical, however, various different structural features have been depicted in each lane illustrated in FIG. 1 solely for the purpose of facilitating the discussion of the present invention.

Referring now to lane 14 illustrated in FIG. 1, two eight-foot long approach modules indicated by reference numbers 18 and 20 are shown to the left of foul line 16. Ball drop panel 22 abuts foul line 16 and is also eight feet in length. Ball drop panel 22 is specially reinforced from below as will be described in greater detail below. Positioned adjacent to ball drop panel 22 is lane module 24 which is also eight feet in length. The remaining structure to the right of lane module 24 has not been illustrated in FIG. 1 although the total length from foul line 16 to the head pin of the pin deck module is approximately 60 feet. In the spaces between lanes 10, 12, and 14 and aligned to the right of foul line 16, conventional gutter assemblies will be positioned. In the same space to the left of foul lines 16, a pair of eight foot long approach modules will be installed to form a continuous deck between the approach areas of the three bowling lanes illustrated.

Referring now to bowling lane 10 in FIG. 1, the location of the $1\frac{1}{2}$ inch by $2\frac{1}{2}$ inch by 41 inch aluminum box channel supports which are secured to the underside of modules 18, 20, 22, and 24 are illustrated by the vertically oriented dashed lines, such as lines 26. As can be seen, the approach modules and lane modules include three box channel supports while the ball drop panel includes only a single box channel support toward the right end. Each of the modules presently being discussed is eight feet in length and approximately $1\frac{1}{2}$ inches thick and is fabricated from a plurality of hardwood strips which have been adhesively bonded side to side into a single layer. Each aluminum box channel support is connected by a plurality of four $2\frac{1}{2}$ inch by $\frac{1}{4}$ inch lag screws to the lower surface of each module and substantially strengthens each module.

The method of removing existing bowling lane structure which is to be replaced and the method of preparing the underlying lane support structure to receive the modular replacement units of the present invention will now be described. Initially, it will be assumed that the pine mid-section of the bowling alley is not to be replaced, but that only the pin-deck area and the areas illustrated in FIG. 1 are to be replaced. The pine lane structure which is to remain must be sanded and refinished in a conventional manner. The approach fill capping and gutters in the interlane area must be removed. A saw outline is marked on the pin deck area which is to be cut away and removed from the existing lane section generally with the assistance of a pin deck template having dimensions identical to those of the replacement pin deck section. A wooden saw template is then placed on the foul line side of the designated saw cut line and a portable electric saw with a carbidetipped blade is positioned beside the saw template to assist in making a straight saw cut which is oriented precisely perpendicular to the sides of the remaining lane structure. The existing pin deck structure is then removed and discarded.

The position of the existing foul line is then measured. If the foul line location complies with American Bowling Congress specifications, this existing foul line may be used as a reference point. If the location of the existing foul line does not comply with these standards, a new foul line reference must be fabricated in accordance with American Bowling Congress specifications. The next saw cut in the pine section of the existing lane section is then made 18 feet, 2 inches down the lane from the foul line reference mark. This second saw cut is made with the same equipment and using the same techniques as has been described above in connection with the pin deck replacement. After this saw cut has been completed, the approach area and ball drop zone of the lane is removed. These sections which are to be replaced may be cut into smaller pieces to facilitate handling.

At this point the coupler bar illustrated in FIG. 10 is connected to each end of the existing lane section. FIG. 9 illustrates the manner in which coupler bar 28 is oriented and secured to existing lane section 30. Generally, a wooden template is utilized to assist in establishing the proper vertical position of coupler bar 28 with respect to the vertical face of existing lane section 30. The vertical face of coupler bar 28 is secured to the vertical face of the existing lane by a plurality of wood screws.

Figure 2:
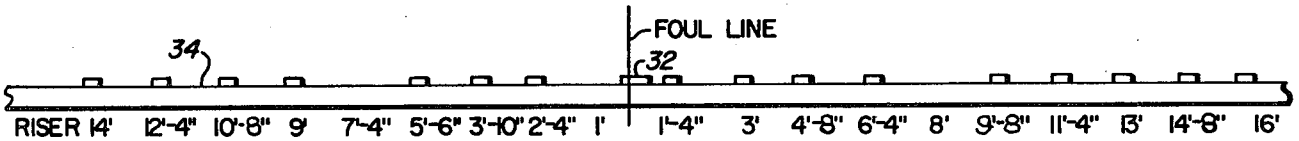
FIGS. 2, 3, and 4 illustrate existing lane structure and the various modifications which must be accomplished to accommodate the modular bowling lane system of the present invention.
Figure 3:
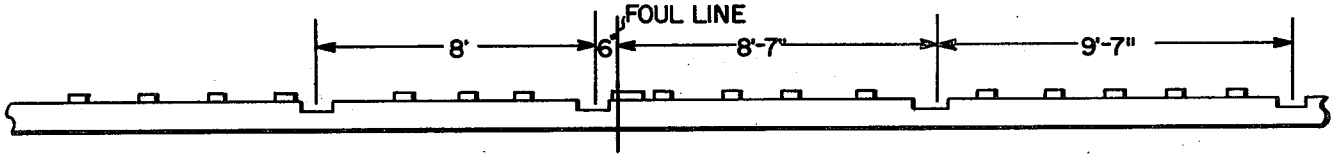
Figure 4:
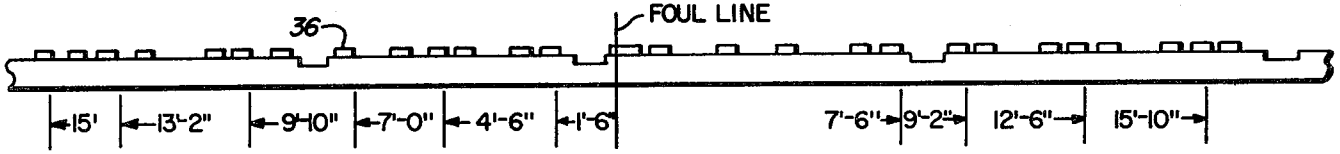

Referring now to FIGS. 2, 3, and 4, the existing foul line leveling strip 32 and the next three leveling strips on the lane side of the foul line must be properly leveled in a conventional level. The vertical position of these four leveling strips must be carefully checked to assure that they are three inches plus or minus $\frac{1}{8}$ inch below the upper surface of the existing lanes. Proper adjustments must be made to meet this specification if necessary. The $\frac{1}{2}$ inch Celotex pads on these four leveling strips is then replaced. The Celotex pads positioned above the other exposed leveling strips are removed and discarded. The position of the foul line along foul line leveling strip 32 must be determined and if the approach side of foul line leveling strip 32 extends more than two inches behind the foul line, the amount exceeding two inches must be cut off. As indicated by FIG. 2, the leveling strips at the eight foot mark on the lane side of the foul line and the leveling strips at the one foot and seven foot four inch marks and the riser on the approach side of foul lines must be removed. FIG. 3 illustrates that a three inch by six inch access notch is cut from the upper surface of the stringers at the positions indicated by the four vertically oriented arrows.

FIG. 4 illustrates the positions at which 1" by 6" by 60" pine foot supports are secured to the stringers on the approach and lane side of the foul line.

Referring now to FIGS. 1, 7, and 8, the manner in which the various types of lane modules are supported above pine foot supports 36 will be described. The lower portion of the end of each hollow aluminum box channel support 26 includes a notch 38 into which the vertically oriented threaded shaft of jack screw foot 40 is inserted. Jack screw foot 40 incorporates a 4"×6" steel plate which includes three apertures 42 that permit the plate to be secured by wood screws to pine foot support 36. Notch 38 permits jack screw foot 40 to readily be inserted from the side without disconnecting the upper nut of the device. The three nuts on the shaft of jack screw foot 40 permit the elevation of the lane modules to be controlled and facilitate the leveling of the various lane modules of the present invention. The two nuts which are positioned below box channel support 26 lock together to prevent further vertical displacements once the desired vertical position has been obtained. Once jack screw foot 40 is positioned as illustrated in FIG. 7, it rigidly couples lane module 24 to foot support 36 and prevents vertical and horizontal translations of the lane module. As is clearly illustrated in FIG. 1, each box channel support is coupled to and supported by a pair of jack screw feet.

Referring now to FIGS. 1, 6, and 15, the structure of ball drop panel 22, the structure of foul line insert 44 and the manner in which abutting lane modules are coupled together will be described in greater detail.

Since ball drop panel 22 receives impacts of substantial magnitude, it is desirable that this panel be specially reinforced. To provide this reinforcement, ball drop panel 22 not only includes a 1½ inch upper laminated deck, but also includes a 1⅛ inch lower reinforcing deck 46, which extends slightly less than eight feet down a lane from foul lane 44 and approximately six inches under approach module 20. Reinforcing deck 46 is formed from a plurality of hardwood strips which are adhesively bonded side to side into a single layer. The upper surface of reinforcing deck 46 is glue bonded to the lower surface of the upper module deck panel. The foul line end of approach module 20 includes a plurality of 12 threaded female fasteners indicated generally by reference number 48 in FIG. 1 and by reference number 50 in FIG. 15. These fasteners are installed at the factory by boring a series of holes at precisely determined locations in the lower surface of the foul line end of approach module 20. Tap-Lok threaded self tapping inserts are screwed into the passageways in the lower surface of approach module 20. Tap-Lok inserts are manufactured by Groov-Pin Corp. of Ridgefield, N.J.

Reinforcing deck 46 of ball drop panel 22 includes a plurality of 12 passageways precisely aligned with each fastener 50 so that once ball drop module 22 and approach module 20 are aligned during the installation procedure in the field, a bolt 52 can readily be secured to fastener 50 and tightened rapidly with a socket wrench. This unique structural arrangement not only provides an extremely strong mechanical coupling between ball drop panel 22 and approach module 20, but also substantially reduces the assembly and installation time of replacement lane modules.

The groove for receiving foul line insert 44 is cut in the upper end surfaces of approach module 20 and ball drop module 22 after these two sections have been bolted in position. A router capable of making a seven degree bevel cut is utilized in this procedure. After this bevel cut has been completed, foul line insert 44 can be positioned by laterally sliding it into place from either side. Foul line insert 44 is thus mechanically maintained in position and glueing or other bonding procedures are rendered unnecessary.

As can be seen from FIGS. 9 and 10, a plurality of threaded female inserts 50 and bolts 52 permit one end of lane module 24 to be readily coupled to coupler bar 28 which was previously secured to existing lane section 30. Reference number 54 designates the end of lane module 24 which is coupled to coupler bar 28. In this installation procedure the bolt 52 is loosely threaded into insert 40 and then the entire lane module is aligned and displaced toward the existing lane section 30. In this manner the exposed shaft of each bolt 52 slips into the open-ended notches 56 in the horizontally oriented surface of coupler bar 28. The three inch by six inch notch cut indicated by reference number 58 which was previously cut into stringer 34 is provided to permit ready access by the installer to the plurality of bolts 52 positioned below end 54 of lane module 24.

Referring now to FIGS. 1 and 5, coupling means in the form of a splice plank 58 joins abutting ends of adjacent lane modules, approach modules, and the junction between ball drop panel 22 and the initial lane module 24. In FIG. 1 reference number 60 designates the positioning of the threaded female fasteners in the various types of lane modules illustrated. Pre-installed threaded female fasteners and matching passageways in splice plank 58 permit the abutting ends of the lane modules to be rapidly and strongly secured together in the field in a manner very similar to that described in connection with the junction between reinforcing deck 46 and overlapping end 48 of approach module 20.

Referring now to FIGS. 5 and 10, the manner in which a replacement pin deck 62 is coupled to existing lane section 30 will now be described. Existing replacement pin decks of various kinds are commercially available and include four jack screw feet which are independently adjustable to level the surface of pin deck 62 with respect to the upper surface of existing lane section 30. As can be seen from FIG. 5, the lower forward edge of pin deck 62 designated by reference number 64 is bevelled. A row of self-tapping threaded female inserts is inserted to the right of bevelled area 64 for receiving and mechanically securing a matching plurality of bolts 66. The vertical face of coupler bar 28 is secured by a plurality of wood screws to the vertical end surface of existing lane section 30 at an appropriate position so that the upper surface of existing lane section 30 will be evenly mated with the upper surface of replacement pin deck 62. Pin deck 62 is installed so that bolts 66 are aligned within notches 56 in coupler bar 28. Pin deck 62 is then leveled and the plurality of bolts 66 are tightened to securely join pin deck 62 to existing lane section 30.

Referring now to FIGS. 1, 11, 12, 13, and 14, the structure and method of assembly of the approach fill module will now be described. In one embodiment of the present invention two 8-foot long approach fill modules are inserted in the area to the left of foul line 16 in the space between adjacent lanes, such as lanes 10 and 12. Approach fill support means in the form of a plurality of slats or first securing means, such as slat 68 are coupled by a pair of bolts and self-tapping threaded female inserts which were positioned during manufacture in the lower surface of the approach section of each adjacent lane. A first end 70 of slat 68 includes a pair of grooves approximately six inches in length, while second end 72 includes a pair of grooves approximately two to three inches in length. The unique configuration of grooves 70 and 72 in slat 68 permits the four bolts which are to secure slat 68 to be partially screwed into the lower surface of adjacent approach modules 18 prior to the time when these modules are installed on the lane support structure. This bolt premounting procedure and the four grooves in each slat substantially reduces the time required to install the approach fill support means since an end 70 of slat 68 can readily be slipped into two mounting bolts a substantial distance which then permits end 12 to be rotated in a horizontal plane into alignment with its two mounting bolts. Slat 68 is then displaced toward end 12 which causes the inner ends of the short notches in end 72 to abutt the two mounting bolts. A socket wrench can then be used to rapidly tighten these four mounting bolts to rigidly secure slat 68 to the adjacent two approach modules.

A single 2×4 plank 74 is inserted between approach modules 20 just behind foul line 16 as shown in FIG. 11. A slat 68 cannot be located near the foul line due to the presence of reinforcing panel 46. Plank 74 is supported by the existing lane support structure and is leveled and then toe-screwed to the lane support structure.

Approach fill modules are narrower than but of essentially the same construction as lane modules 24. Since it is common for the distance between adjacent approach fill modules of two adjacent lanes to vary somewhat, the width of the approach fill modules generally will have to be trimmed in the field to the desired dimension.

The approach fill modules are secured to each slat 68 by second securing means which may take the form of a plurality of clip blocks 76 of the type illustrated in FIGS. 12 and 14. Each clip block 76 comprises a wooden block to which a forward projecting metal spring clip 78 is attached as shown. Generally, three clip blocks 76 are coupled at intervals laterally across each approach fill module and are positioned so that when the approach fill module is dropped in place and slipped forward each clip block tightly engages a slat as illustrated in FIG. 13. In this manner each of the two approach fill modules can readily be installed and removed. The necessity for boring holes from the top vertically through the approach fill module to secure it to the underlying lane support structure is thereby eliminated. Appropriate ball return holes can be cut in the approach fill module which is positioned closest to the foul line 16.

Referring now to FIG. 6, one of many possible alternative embodiments of the system of the present invention is illustrated. In this embodiment a single 16-foot long lane module 80 is provided. In this particular embodiment the totality of the existing lane structure is removed and two additional lane modules 84 are installed between ball drop module 80 and pin deck module 86. Coupler bar 28 is installed with the orientation illustrated in FIG. 9. The structural features of the embodiment described at length above and the embodiment illustrated in FIG. 6 are essentially identical. The actual length and number of the various types of modules utilized in the system of the present invention can be changed at will and specifically configured for the requirements of each customer. In certain installations, it may be desirable to add a laminated plastic panel to the upper surface of each of the various types of modules to increase the wear and durability of the replacement lane surface. Well known techniques exist for applying plastic laminates to wooden surfaces of the type used in the various types of lane modules.

The method for converting a hardwood plank having a horizontally oriented grain structure into a plurality of hardwood strips having side and bottom surfaces suitable for lamination is fully described in U.S. Pat. No. 4,169,602, by Will Heddon, which is hereby incorporated by reference. Similarly, the method and technique of utilizing an electronic gluing machine to permanently bond these wood strips together into a rectangular deck is also described herein.

Referring now to FIG. 16, a second embodiment of an approach fill module 100 is illustrated. Approach fill module 100 is formed from first and second wing panels 102 and 104 and keyway panel 106. It is generally desirable but not absolutely necessary to provide first and second expansion joints 108 and 110 which have a height of approximately one and one half inches and a thickness of approximately three-sixteenths of an inch. These expansion joints are fabricated from closed cell polyvinyl plastic and are adhesively bonded to the inner side surfaces of the wing panels. Expansion joints 108 and 110 maintain a compression fit between the adjacent side surfaces of the wing and keyway panels so that the upper surface of approach fill module 100 is maintained smooth and uniform even though the wing and keyway panels may be dimensionally unstable to a very limited degree as a result of changes in temperature and humidity.

The wing and keyway panels are generally fabricated in eight-foot sections. Wing panels 102 and 104 are fabricated in standard seven and one-half inch width units while keyway panel 106 is fabricated in a standard fourteen and one-half inch width. The approach sections of adjacent lanes 112 and 114 may be separated by a distance of either twenty and three-quarter inches or twenty-eight and one-quarter inches depending on whether a ball return is included between the adjacent lanes. Since the two wing panels provide a combined width of fifteen inches, the fourteen and one-half inch keyway panel 106 must be cut down at the installation site to a width of either five and three-quarter inches or thirteen and one-half inches. Keyway panel 106 is fabricated in an oversize standard width of fourteen and one-half inches to accommodate dimensional variations which may exist in various bowling establishments. The three element approach fill module illustrated in FIG. 16 may be used to either replace the approach fill area of an existing lane or to fabricate the approach fill section of a newly constructed bowling facility.

Referring now to FIGS. 16–19, the manner in which approach fill module 100 is secured to the bowling lane will now be described in some detail. Approach fill support means may take the form of a plurality of slats, such as slat 116. Each slat includes a first end which is coupled to the lower surface of approach area 112 and a second end which is coupled to the lower surface of approach area 114 in order to support the lower surface of approach fill module 100 and to maintain the upper surface of that module level with the upper surface of approach areas 112 and 114.

First securing means indicated generally by reference number 118 comprises a plurality of Z-shaped clips manufactured from spring steel. Clips 118 are coupled to the lower surfaces of first and second wing panels 102 and 104 and keyway panel 106 in positions aligned with the various slats. Clips 118 can be coupled to the lower surface of approach fill module 100 by screws, by bolts interfacing with self-tapping threaded female inserts of the type described above, or by various other methods well known to those skilled in the art. Generally, a single clip will be coupled to the lower surface of each of the three sections of approach fill module 100 to permit a single clip to interface with each of the numerous slats provided.

Second securing means in the form of clamping means 120 secures the first end of each slat to the lower surface of the approach area of the first lane and secures the second end of each slat to the lower surface of the approach area of the second lane. Clamping means 120 includes a clamping bar 122 having a length greater than the width of slat 116. The ends of clamping bar 122 extend beyond the sides of slat 116 and include an aperture for receiving a bolt 124. Each of the bolts 124 engages a self-tapping threaded female insert 126 which is installed during assembly of the approach fill module at the factory.

During installation bolts 124 and clamping bar 122 are loosened into a first position which permits one end of slat 116 to be inserted within clamping means 120 as is specifically illustrated in FIG. 18. After the end of slat 116 is inserted within clamping means 120, bolts 122 are tightened down into a second position which biases clamping bar 122 firmly against the lower surface of slat 116 to secure the end of slat 116 to the lower surface of approach section 112.

The unique structure of clamping means 120 permits bolts 124 and clamping bar 122 to be installed before slat 116 is inserted into position so that slat 116 does not interfere with the workman during this assembly procedure. After clamping means 120 has been installed at the appropriate position on the lower surface of approach sections 112 and 114, slat 116 can readily be slipped into position. At this point clamping means 120 can be tightened at both ends of slat 116 to firmly secure slat 116 into a fixed position.

Figure 19A:
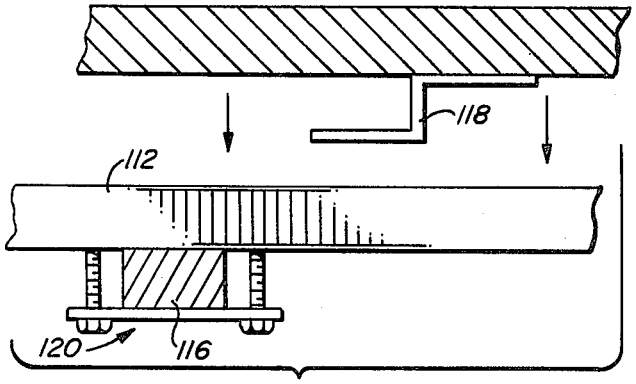
FIGS. 19A-C constitute a series of sectional views illustrating the procedure for securing the elements of an approach fill module to the approach fill support means of the present invention.
Figure 19B:
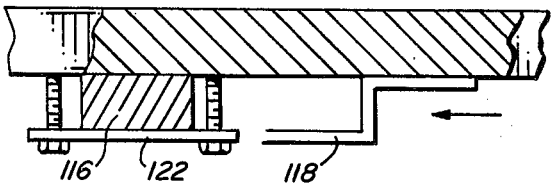
Figure 19C:
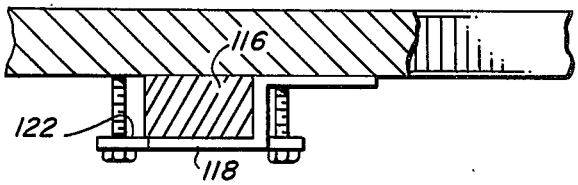

After all of the slats 116 are firmly secured in position, the procedure illustrated in FIGS. 19-A through 19-C is followed to position and secure wing panels 102 and 104 and keyway panel 106 in position. The two wing panels 102 and 104 are first locked into position as illustrated in FIG. 19-C and include first and second expansion joints 108 and 110 which are adhesively bonded to the exposed inner side surfaces. Finally, a properly dimensioned keyway panel 106 is lowered and then locked into position by following the procedure illustrated in FIG. 19. The side surfaces of keyway panel 106 are not adhesively bonded to expansion joints 108 and 110.

Figure 20:
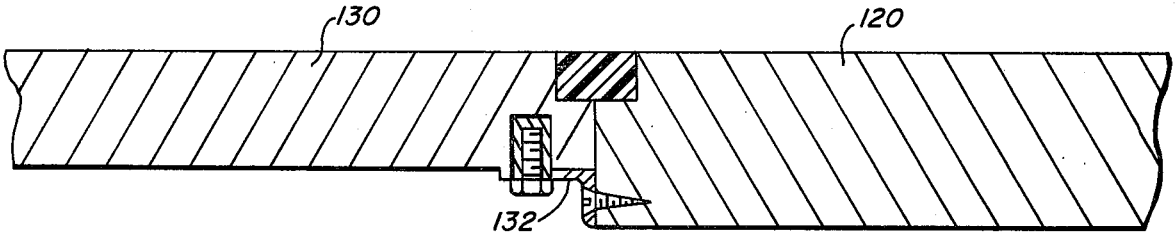
FIG. 20 illustrates the manner in which a coupler bar is utilized to couple an approach module to the up lane end of a ball drop module.

Referring now to FIG. 20, a ball drop module 128 is illustrated which has been fabricated from a plurality of hardwood strips adhesively bonded side to side in a single layer. Ball drop module 120 differs from the ball drop module described in FIG. 15 in that ball drop module 120 is thicker and does not include a reinforcing panel. Ball drop module 120 can be fabricated with a thickness of approximately two and one-quarter inches and is illustrated as being coupled to an approach module 130 having a thickness of approximately one and one-half inches.

A coupler bar 132 is provided to couple together ball drop module 120 and approach module 130. Coupler bar 132 is virtually identical in structure and function to coupler bar 28 illustrated in FIG. 10, except that it may be necessary to modify the vertical and the horizontal face dimensions of coupler bar 132 to accommodate the three-quarter inch thickness differential between approach module 130 and ball drop module 120.

Figure 21:
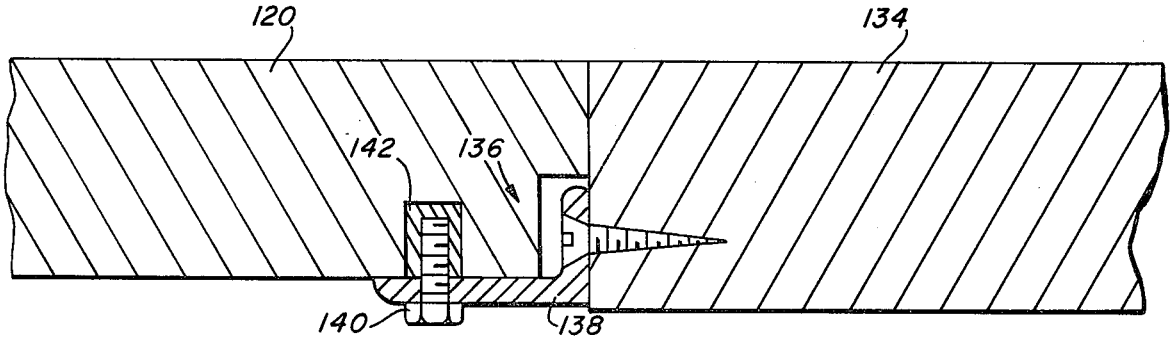
FIG. 21 illustrates the manner in which another coupler bar configuration can be used to couple the down lane end of a ball drop module to an abutting section of an existing bowling lane.

FIG. 21 illustrates the manner in which the downlane end of ball drop module 120 might be coupled to a section of an existing lane 134 which is not to be replaced. As is illustrated, the lower end surface of ball drop module 120 has been modified to include a notch 136 which is designed to receive the vertical face of coupler bar 138 which extends upward from the horizontal face of coupler bar 138. During assembly a template can be used to properly position the vertical face of coupler bar 138 with respect to the end of existing lane 134. A plurality of wood screws are then utilized to couple the vertical face of coupler bar 138 to the exposed end of existing lane section 134. Ball drop module 120 is then positioned as illustrated in FIG. 21. Bolts 140 can be attached to the self-tapping threaded female inserts 142 before ball drop module is positioned adjacent to existing lane 134 in order to expedite the assembly of the replacement lane section. The horizontal face of coupler bar 138 may have open ended grooves of the type illustrated in FIG. 10 by reference number 56 to permit this expedited assembly technique, or alternatively, may utilize round apertures or passageways. This latter configuration would required that bolts 140 be threaded and tightened after ball drop module 120 had been placed in abutting contact with lane section 134 and would thereby require a more time consuming assembly procedure.

The configuration of coupler bar 138 permits modules fabricated in accordance with the teachings of the present invention to be readily coupled to sections of an existing lane or to a pin deck module which have thicknesses either greater than or less than the thickness of the modular lane section to which the coupler bar is attached. The dimension of notch 136 and the dimension of the vertical face of coupler bar 138 must be designed to accommodate the thickness differential between the two lane sections being joined together.

The system of the present invention possesses numerous advantages over prior art bowling lane construction and reconstruction techniques. An entire bowling lane or a partial bowling lane replacement structure can readily be assembled at the installation site by unskilled laborers who utilize simple tools such as a portable electric saw, a socket wrench, a screwdriver, a hammer and related items. The system of the present invention provides techniques which readily permit abutting modules to be rapidly coupled together and further permits these pre-fabricated modules to be coupled to existing lane structure which may not need to be replaced. The techniques for adjusting the height of the various lane modules and for properly leveling them are readily accomplished. The approach fill support means for each lane can be secured in place in a matter of minutes and shortly thereafter the approach fill modules can be positioned and secured. All guide marks and pin spots on various portions of the lane replacement modules will have been installed at the factory. The time required to install a partial replacement bowling lane at the installation site can be reduced by approximately 80 to 90 percent in comparison with prior art reconstruction techniques. The bowling alley down time can be reduced by corresponding percentages.

It will be apparent to those skilled in the art that the disclosed modular bowling lane system may be modified in numerous ways and may assume many embodiments other than the preferred forms specifically set out and described above. Accordingly, it is intended by the appended claims to cover all such modifications of the invention which fall within the true spirit and scope of the invention.

I claim:

1. In a bowling alley having a lane, leveling strips positioned below and perpendicular to the lane, and lane support structure positioned below the leveling strips and parallel to the lane, a modular lane system comprising:

a. a rectangular deck having an end and upper and lower surfaces, said deck formed from a plurality of hardwood strips adhesively bonded side to side in a single layer to form a lane module;

b. means coupled to said module and to said leveling strips for supporting said module at a predetermined distance above said lane support structure;

c. a coupler bar positioned below one end of said module for coupling the end of said module to an adjacent section of said lane and for preventing relative vertical displacement between said module and said adjacent section of said lane, said coupler bar comprising:

(i) a vertical face including a plurality of passageways for receiving first securing means to attach the vertical face of said coupler bar to the end of said adjacent lane section; and (ii) a horizontal face including a plurality of passageways for receiving second securing means to attach the horizontal face of said coupler bar to the lower surface of said module.

2. The modular lane system of claim 1 wherein said module forms a part of the approach section of said lane.

3. The modular lane system of claim 1 wherein said lane includes a foul line and a pin deck and wherein said module is positioned between the foul line and the pin deck.

4. The modular lane system of claim 1 further comprising an adjacent lane section having a second lane module with a thickness greater than said lane module.

5. The modular lane system of claim 1 wherein said lane modules forms a part of the approach section of said lane and wherein said second lane module forms a part of the ball drop zone of said lane.

6. The modular lane system of claim 1 further including a plurality of support members coupled at intervals to the lower surface of said module and laterally spanning said module for reinforcing said module.

7. The modular bowling lane system of claim 6 wherein each of said support members includes a notch in the lower surface thereof for receiving said module support means.

8. The modular lane system of claim 1 wherein said module support means includes a plurality of jack screws.

9. The modular lane system of claim 8 wherein said jack screws are coupled at predetermined points around the lower periphery of said module.

10. The modular lane system of claim 1 wherein the passageways in the horizontal face of said coupler bar are notch-shaped.

11. The modular lane system of claim 1 wherein said coupler bar is L-shaped.

12. The modular lane system of claim 11 wherein said coupler bar has a length equal to the width of said module.

13. The modular lane system of claim 1 wherein said first securing means includes a plurality of wood screws for securing the vertical face of said coupler bar to the exposed vertical face of said lane section.

14. The modular lane system of claim 1 wherein the lower end section of said module includes a plurality of threaded passageways and wherein said second securing means comprises a plurality of bolts passing vertically upward through the passageways in the horizontal face of said coupler bar into said threaded passageways for securing said coupler bar to the lower surface of said module.

15. The modular lane system of claim 1 wherein said coupler bar couples said module to a pin deck module.

16. The modular lane system of claim 1 wherein said module comprises a pin deck module and wherein said coupler bar couples said pin deck module to an existing lane section.

17. The modular lane system of claim 1 wherein the vertical face of said coupler bar extends below the horizontal face of said coupler bar.

18. The modular lane system of claim 1 wherein the lower end of said module includes a notch and wherein the vertical face of said coupler bar extends above the horizontal face of said coupler bar into said notch.

* * * * *